United States Patent [19]

Messina

[11] Patent Number: 5,071,122

[45] Date of Patent: Dec. 10, 1991

[54] BASEBALL BATTING TRAINING APPARATUS

[76] Inventor: Joseph A. Messina, 31 Arbutus Way, Staten Island, N.Y. 10312

[21] Appl. No.: 712,268

[22] Filed: Jun. 7, 1991

Related U.S. Application Data

[63] Continuation-in-part of Ser. No. 552,146, Jul. 12, 1990, abandoned.

[51] Int. Cl.[5] ..... A63B 69/40

[52] U.S. Cl. ..... 273/26 R

[58] Field of Search ..... 273/26 R, 29 A, 29 R, 273/1 GE, DIG. 24, 586, 184 B, 184 C, 186 R, 186 C, 183 E, 187 D, 25

[56] References Cited

U.S. PATENT DOCUMENTS

| | | | |
|---|---|---|---|
| 4,461,477 | 7/1984 | Stewart | 273/186 C |
| 4,515,365 | 5/1985 | Horikoshi et al. | 273/25 |
| 4,534,557 | 8/1985 | Bigelow | 273/55 A |
| 4,545,576 | 10/1985 | Harris | 273/25 |
| 4,627,620 | 12/1986 | Yang | 273/1 GC |
| 4,708,343 | 11/1987 | D'Ambrosio | 273/26 R |
| 4,824,237 | 4/1989 | Ratner et al. | 273/26 R |
| 4,834,375 | 5/1989 | Elstein et al. | 273/26 R |

*Primary Examiner*—Theatrice Brown

*Attorney, Agent, or Firm*—Samuelson & Jacob

[57] ABSTRACT

Batting training apparatus for improving the batting performance of a baseball batter, the apparatus having a plurality of baseball-simulating targets placed within a simulated strike zone and mounted for rotation about a vertical axis in response to being struck by a baseball bat, a plurality of illuminating lamps associated one with each one of the targets, a selector for illuminating a selected one of the plurality of targets to simulate a particular pitch, a timer for measuring the time between illumination of the selected lamp and the commencement of movement of the target in response to being struck by the baseball bat to indicate the reaction time of the batter, and a counter for counting the number of revolutions of the target about the vertical axis to indicate the quality of the strike upon the target by the baseball bat.

9 Claims, 3 Drawing Sheets

BASEBALL BATTING TRAINING APPARATUS

This is a continuation-in-part of application Ser. No. 552,146, filed July 12, 1990, now abandoned.

The present invention relates generally to athletic training apparatus and pertains, more specifically, to apparatus for improving the skill of a batter in hitting a baseball, the apparatus being especially constructed to improve the batter's athletic acuity, including concentration, hand-eye coordination, reaction time, knowledge of the strike zone, speed and accuracy.

The game of baseball has been popular across a broad spectrum of the population for a very long time, in both formal structured competition and informal unstructured play. The game engenders competition and group interaction, coupled with physical exercise, thereby simultaneously serving several useful purposes for many people.

The desire among baseball players to excel and perform more effectively has led to the development of a variety of apparatus and methods designed to improve and perfect the skills of baseball players, and especially those skills related to proficiency in swinging a baseball bat to hit a pitched baseball. While many baseball batting training devices have been made available over the years, most of these devices have exhibited certain shortcomings by way of complexity or effectiveness. Thus, simpler, less expensive devices, while available to a larger number of end users, are not very effective, and more effective devices are complex and more expensive, limiting availability to only a small number of the potentially large population of users in the field.

Some examples of known baseball batting practice devices are found in the following United States patents: U.S. Pat. No. 4,461,477 employs distant signal lights requiring the batter to swing at an imaginary object rather than an actual target. U.S. Pat. No. 4,515,365 employs a complex light beam pattern emitted from a simulated "home plate", coupled with a complex electronic evaluation mechanism. U.S. Pat. No. 4,708,343 also relies upon a remote source of multiple signal lights to initiate a "swing response" from a batter. U.S. Pat. No. 4,824,237 discloses a hand-to-eye coordinating device not truly related to improving a batter's swing. U.S. Pat. No. 4,834,375 employs a programmable sequence of signal lights which indicate to a batter which one of several batting routines is to be followed by the batter. Thus, the device requires the batter to first interpret the signal provided by a signal light and then act upon the understood previously learned routine. Accordingly, the device does not evaluate true reaction time in that the batter's reaction to a signal light requires the completion of a mental interpretation of the signal prior to the start of the batter's swing, thereby adding time to the complete process.

The present invention provides baseball batting training apparatus which overcomes the shortcomings of previous devices and which exhibits several objects and advantages, some of which may be summarized as follows: Provides a batter with a baseball-simulating target placed in a simulated strike zone in such a way as to present the batter with a realistic batting situation in a practice environment; facilitates variations in the batting situation presented to a batter for ease of operation by a trainer and the more effective development of batting skills and athletic acuity; accommodates a wide variety of batters having different physical characteristics with increased ease; provides a direct measurement of reaction time and batting accuracy for improving all facets of batting skills; enables increased ease of use through simplicity of set-up and operation; provides a lightweight, portable apparatus enabling compact storage and ease of transportation; may be utilized in a wide variety of training facilities, including facilities having severely limited training space, both indoors and outdoors; provides a rugged construction which enables reliable operation over a long service life; enables a simplified construction which is manufactured with economy in large numbers of consistent high quality.

The above objects and advantages, as well as further objects and advantages, are attained by the present invention, which may be described briefly as batting training apparatus for improving the batting performance of a baseball batter located adjacent a simulated strike zone and wielding a baseball bat, the batting practice apparatus comprising: a support for placement adjacent the simulated strike zone, the support extending altitudinally to define a vertical axis; a plurality of baseball-simulating targets, each target being spaced horizontally from the vertical axis and mounted on the support for rotation about the vertical axis so as to be movable along a path of travel passing through the simulated strike zone, the targets being spaced altitudinally from one another such that each target, when at rest, is placed at a corresponding rest position in the simulated strike zone, the rest position representing a particular pitch; a plurality of illuminating lamps, each illuminating lamp being associated with a corresponding target at the rest position such that upon illumination of a selected one of the plurality of illuminating lamps, the corresponding target in the simulated strike zone will be illuminated; selector means for selectively illuminating a selected one of the illuminating lamps so as to illuminate a corresponding selected target at the rest position thereof in the simulated strike zone and thereby simulate a particular pitch; and timer means for measuring the time elapsed between illumination of the selected target and the commencement of movement of the selected target away from the rest position and along the path of travel in response to striking of the illuminated target by the batter.

The invention will be understood more fully, while still further objects and advantages will become apparent, in the following detailed description of a preferred embodiment of the invention illustrated in the accompanying drawing, in which.

Figure 1:
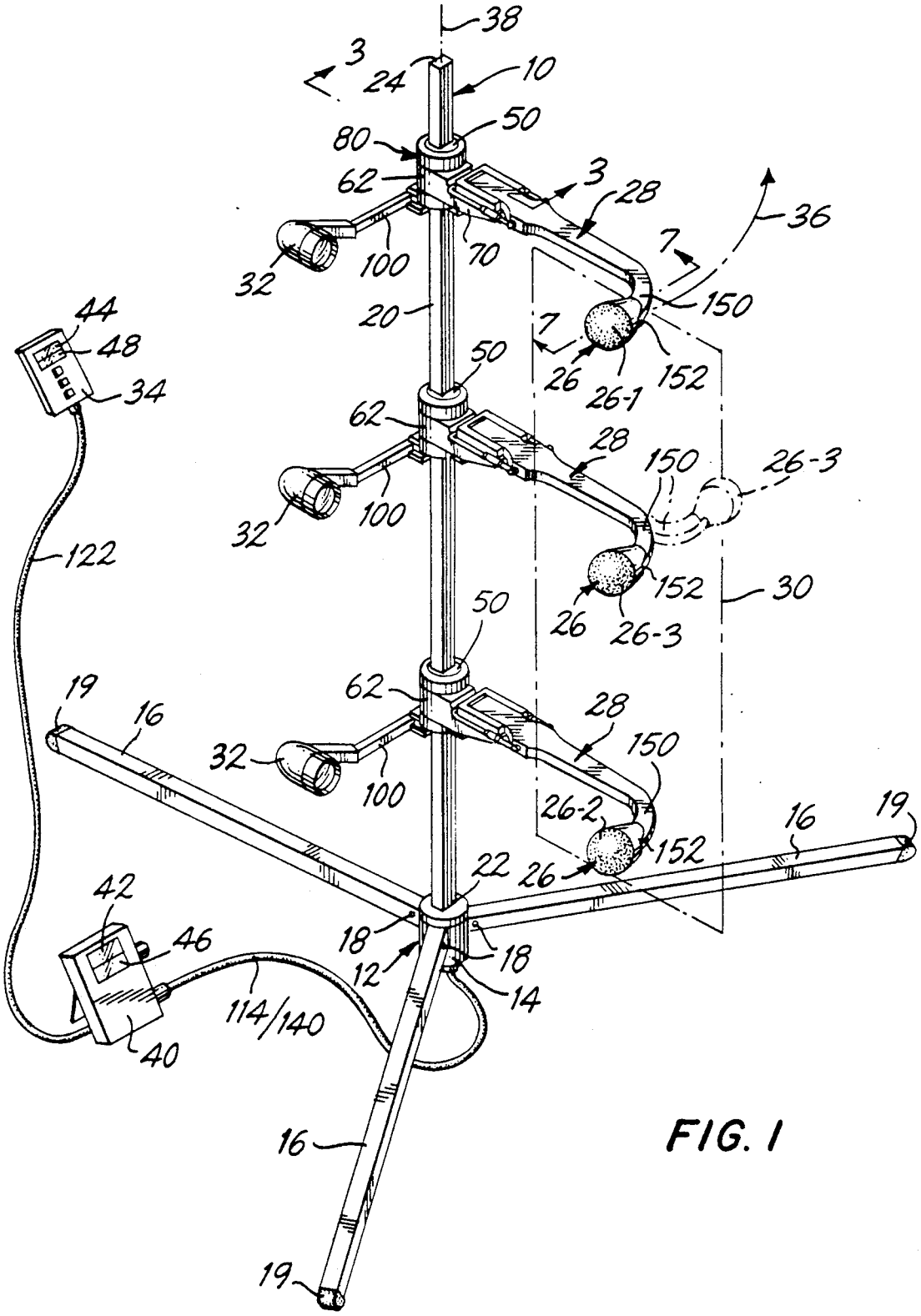
FIG. 1 is a pictorial perspective of a baseball batting training apparatus constructed in accordance with the invention.

Referring now to the drawing, and especially to FIG. 1 thereof, a baseball batting training apparatus constructed in accordance with the present invention is illustrated at 10 and is seen to have a base 12 which includes a hub 14 and three legs 16 radiating from the hub 14 for supporting the base 12 upon a support surface (not shown) located at almost any site selected for a practice facility. Legs 16 each are hinged at the near end of the legs 16 to hub 14 at 18 so as to be foldable relative to the hub 14 for compact storage and transportation. Elastomeric feet 19 at the far ends of the legs 16 protect the support surface at the practice facility against marring, while providing a firm support for the apparatus 10.

A support in the form of a post 20 is secured within the hub 14 and extends altitudinally in a vertical direction between a lower end 22 and an upper end 24. A plurality of baseball-simulating targets 26 are supported by post 20 and are spaced horizontally away from the post 20 by corresponding arms 28 which extend radially from the post 20 to place the targets 26 within a simulated strike zone 30 adjacent the apparatus 10. Targets 26 are spaced apart vertically from one another so that each target 26 is placed at a location where a particular pitched ball would be as a result of a given pitch. Thus, the uppermost target 26-1 represents a high ball, the lowermost target 26-2 represents a low ball, and the central target 26-3 represents a ball which enters the strike zone 30 intermediate the high ball and low ball locations, all as presented to a batter (not shown) who stands adjacent the strike zone 30.

A plurality of illuminating lamps 32 also are supported on the post 20, such that one lamp 32 is associated with a corresponding one target 26. Each lamp 32 is spaced away from the target 26 with which the lamp 32 is associated, but is aimed directly at the associated target 26 when that target 26 is at a rest position in the strike zone 30, as shown. A controller in the form of control box 34 is held by a trainer (not shown) at a remote location and enables the trainer to select which one of the three lamps 32 is to be illuminated, while the batter stands, in a batting stance, wielding a baseball bat, adjacent the strike zone 30. Upon such selection, one of the lamps 32 is illuminated, thereby illuminating the corresponding target 26 located in the strike zone 30. The batter, seeing the illuminated target 26, immediately swings the bat at the illuminated target 26, as if the target 26 were an actual baseball arriving in the strike zone 30 as a result of the particular pitch represented by the illuminated target 26.

Once hit, the struck target 26 will depart from the rest position illustrated in FIG. 1 and begin travel along a circular path of travel 36 passing through the strike zone 30 as the target 26 rotates about a vertical axis 38 established by the post 20. The time elapsed between the illumination of lamp 32 and the commencement of travel of the struck target 26 is measured by timing means which include a timer 39 (see FIG. 6) incorporated within a processor 40 which includes a time display 42 for displaying the elapsed time for view by the batter. A duplicate time display 44 is provided at the control box 34 so that the trainer also can view the elapsed time immediately. In this manner, both the batter and the trainer have an immediate indication of the batter's reaction time. It is noted that since the batter reacts to the direct illumination of a selected target 26, without knowing ahead of time which target 26 will be illuminated, the measured time is an indication of true reaction time and simulates accurately the batter's reaction to an actual pitch.

In order to evaluate the intensity and the accuracy with which the target 26 is struck, processor 40 also includes qualitative means for indicating the quality of the strike upon the target 26, the qualitative means being in the form of counting means including a counter 45 (see FIG. 6) for counting the number of revolutions about axis 38 traversed by the target 26 as the target 26 travels along the path of travel 36. A revolutions display 46 displays the number of revolutions traversed by the struck target 26, before the target 26 comes to rest, and thus provides an indication of the quality of the hit executed by the batter. A duplicate revolutions display 48 is provided at the control box 40 so that both the batter and the trainer have an immediate indication of the quality of the hit, as well as the batter's reaction time.

Figure 2:
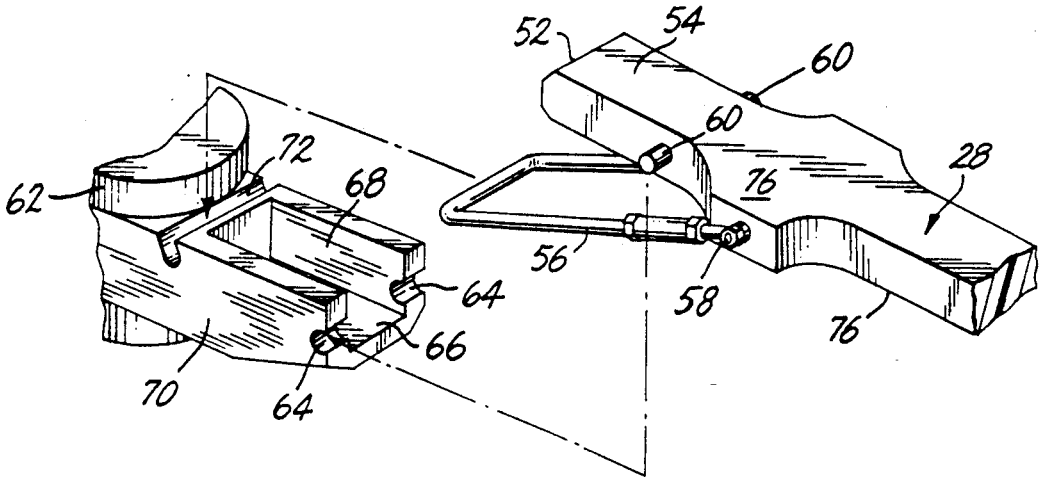
FIG. 2 is an enlarged fragmentary perspective view of a portion of the apparatus.

Turning now to FIGS. 2 through 5, each arm 28 is journaled for rotation about a bushing 50 which itself is movable by sliding along the post 20 to a selected altitudinal position on the post 20. Coupling means secure each arm 28 to a corresponding bushing 50 selectively so as to enable selective removal of each arm 28 for transportation and storage. As best seen in FIG. 2, the near end 52 of arm 28 includes a tongue 54 and carries a bail 56 pivoted about a transverse shaft 58 located adjacent the near end 52 and transverse locking pins 60 located between the transverse shaft 58 and the near end 52. The arm 28 is secured to a bearing member 62 by placing the locking pins 60 in complementary notches 64 located at the mouth 66 of a channel 68 in a bracket 70 integral with the bearing member 62. The bail 56 then is inserted into a transverse groove 72 in the bearing member 62 and the tongue 54 is swung into securement in the channel 68. It is noted that the transverse shaft 58 and the locking pins 60 are located in a plane of symmetry 74, thereby providing reversing means so that the arm 28 may be mounted upon the bearing member 62 with either of the faces 76 of the arm 28 facing upwardly. In this manner, each arm 28 may be mounted selectively to accommodate a left-handed batter, as shown in full lines in FIG. 1, or to accommodate a right-handed batter, as shown in phantom at target 26-3 in FIG. 1. In addition, arm 28 may be interchanged selectively with a longer or a shorter arm (not shown) of similar construction to simulate an inside pitch or an outside pitch, respectively.

Bushing 50 includes an internal passage 78 having a cross-sectional configuration complementary to the cross-sectional configuration of post 20 and is received on post 20 in sliding engagement so that each bushing 50 can be moved selectively to a particular vertical position for placement of a corresponding target 26 in a desired position in the strike zone 30. A locking mechanism 80 is carried by each bushing 50 and includes a locking collar 82 coupled with a locking ring 84 such that manual rotation of the locking collar 82 will rotate locking ring 84 relative to the bushing 50, while bushing 50 remains stationary by virtue of the rectangular cross-sectional configuration of the passage 78. Locking ring 84 has an eccentric internal surface 86 which engages a follower 88 movable in radial directions within a radially-directed bore 90 in wall 92 of bushing 50, toward and away from a resilient locking tab 94 integral with wall 92. In the unlocked position depicted in FIGS. 3 and 4, the locking tab 94 is biased away from the post 20 by the resiliency of the material of the locking tab 94. Upon rotation of the locking collar 82 and the locking ring 84 away from the position shown in FIG. 4, the eccentric internal surface 86 will urge the follower 88 against the locking tab 94 which, in turn, will be urged against the post 20 to lock the bushing 50 in place on the post 20. Thus, bushing 50, and corresponding arm 28, may be placed at any desired location along the post 20 and locked in place at that selected location to simulate selected pitches and to accommodate different batters.

Each lamp 32 is carried by a corresponding rod 100 affixed to a bushing 50. A spindle 102 projects from each bushing 50 and is received within a socket 104 in each rod 100. A clamping screw 106 passes through the rod 100 adjacent the socket 104 and clamps the socket tightly onto the spindle 102 to secure the rod 100 in place on the bushing 50, so that the lamp 32 carried by the rod 100 will be in an appropriate position to illuminate the target 26 carried by the corresponding arm 28, but will be outside the path of travel 36 of the target 26. Loosening of the clamping screw 106 enables selective reorientation of the rod 100 by rotation of the rod 100 about the spindle 102 to match reorientation of the arm 28 and the corresponding target 26 when accommodating to a left-handed batter or a right-handed batter, as set forth above.

Figure 3:
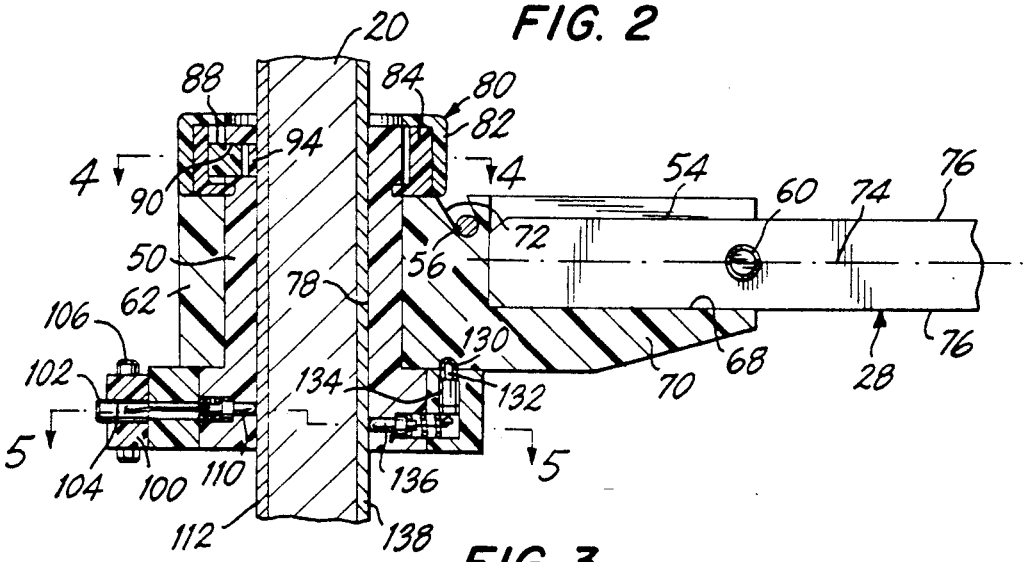
FIG. 3 is an enlarged fragmentary cross-sectional view taken along line 3—3 of FIG. 1.
Figure 4:
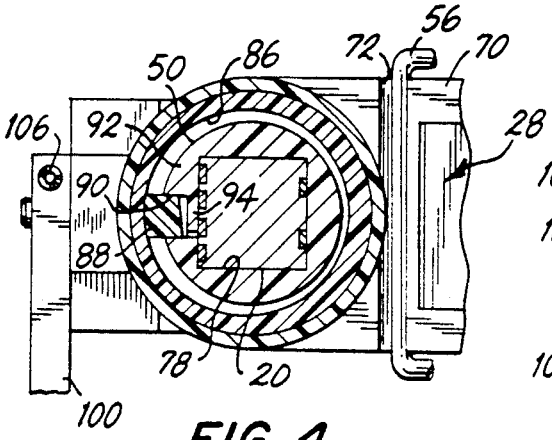
FIG. 4 is a cross-sectional view taken along line 4—4 of FIG. 3.
Figure 5:
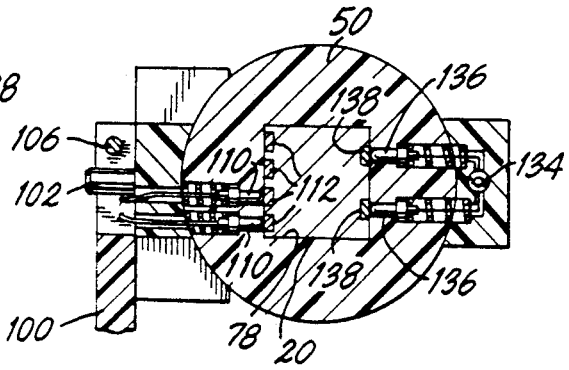
FIG. 5 is a cross-sectional view taken along line 5—5 of FIG. 3.
Figure 6:
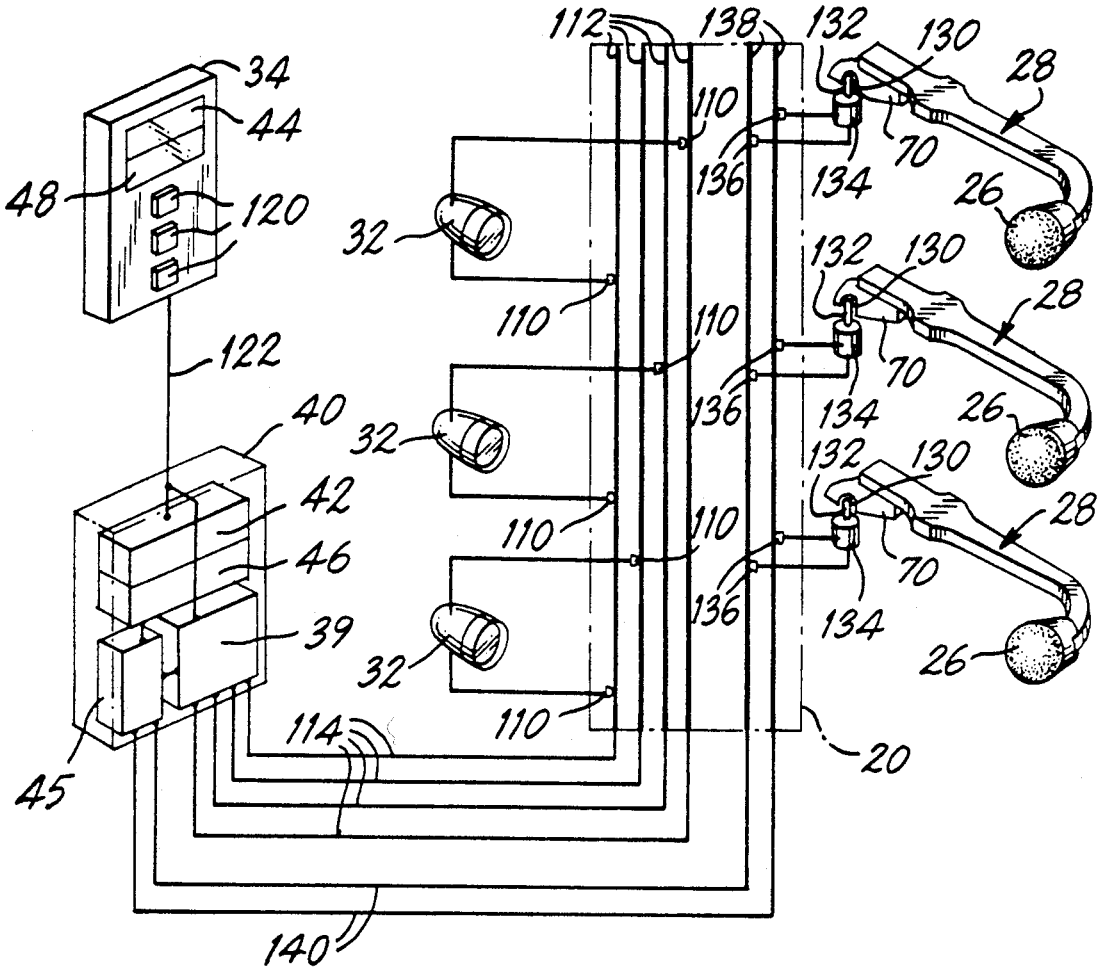
FIG. 6 is a schematic, block diagram of the apparatus.

Referring now to FIG. 6, as well as to FIGS. 3 through 5, each lamp 32 is connected electrically to a pair of electrical contacts 110 carried by the bushing 50 and biased toward a corresponding pair of four contact bars 112 embedded in the post 20 and extending along the length of the post 20. The contact bars 112 are electrically insulated from one another and extend along the length of the post 20 to assure that electrical contact is maintained between the contacts 110 and the contact bars 112 at any selected position of the bushing 50 along the post 20. The four contact bars 112 provide a separate circuit for each of the lamps 32, and all of the circuits are connected to the processor 40 by electrical conductors 114. The control box 34 includes three selectors 120, each selector 120 being associated with one of the lamps 32 so that the trainer may select one of the three lamps 32 for illumination. Upon such selection, the selection is transmitted to the processor 40 through a cable 122 and the circuit to the selected lamp 32 is activated to illuminate the selected lamp 32. At the same time, a timing cycle is initiated in the timer 39 of the processor 40.

The bracket 70 of each bearing member 62 has a sensing element in the form of a semi-spherical recess 130. When the corresponding arm 28 is in the rest position, as depicted in FIG. 1 as well as in FIG. 6, recess 130 is aligned with the actuator 132 of an electrical switch 134 carried by the bushing 50. Switch 134 is connected to electrical contacts 136 which are biased into contact with electrical contact bars 138 embedded in the post 20 and electrically insulated from one another. Contact bars 138 extend along the length of the post 20 so that contact between the contacts 136 and the contact bars 138 is maintained at all positions of the bushing 50 along the post 20. Contact bars 138 are connected electrically to the processor 40 by electrical conductors 140. With all of the arms 28 in their respective rest positions, all of the switches 134 are open and the circuit between the contact bars 138 is open. Upon striking one of the targets 26, the corresponding arm 28 will move from the rest position to commence movement along the path of travel 36, and the corresponding switch 134 will be actuated to close the circuit between the contact bars 138. The time between illumination of a lamp 32 and such initial actuation of the corresponding switch 134 is measured by the timer 39 in the processor 40 and is displayed in the time displays 42 and 44.

Continued movement of the arm 28 along the path of travel 36 through more than one complete revolution about the vertical axis 38 momentarily will open switch 134 as the recess 130 in the bracket 70 of the bearing member 62 passes the actuator 132 of the switch 134 during each revolution. The counter 45 of the processor 40 counts the number of actuations of the switch 134 and the processor 40 displays the corresponding number of revolutions of the arm 28 at the revolutions displays 46 and 48. Thus, both the batter and the trainer are provided with an immediate read-out of reaction time and the quality of the hit.

Figure 7:
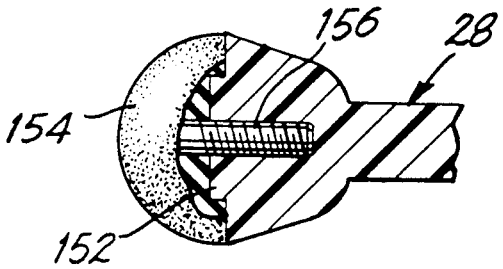
FIG. 7 is an enlarged fragmentary view of a portion of the apparatus, partially sectioned along line 7—7 of FIG. 1.

As best seen in FIG. 1, the arms 28 each include a redirected portion shown in the form of curved portion 150 adjacent the far end 152 of the arm 28 so that the target 26 is placed in full confrontation with the bat (not shown) of the batter. Thus, the redirected curved portion 150 of each arm 28 extends the arm 28 in a generally circumferential direction to place the target 26 in a position where the target 26 best simulates the position of a baseball in the strike zone 30 and presents a target which can be struck most like a baseball. At the same time, the described construction provides a rugged and durable target arrangement. Turning now to FIG. 7, target 26 is seen to include a semi-spherical target member 154 constructed of an elastomeric material chosen to match the characteristics of a baseball. A threaded stud 156 secured to the target member 154 is threaded into the far end 152 of the arm 28 and enables selective removal and replacement of the target member 154, should the target member 154 become worn or damaged. As described above, the curved portion 150 of arm 28 may be reoriented selectively to be directed in either one of two opposite generally circumferential directions for accommodating both left-handed and right-handed batters, and a corresponding reorientation of the counterpart lamp 32 maintains the appropriate relationship between each lamp 32 and a corresponding target 26.

It will be seen that the apparatus 10 attains the objects and advantages outlined above, namely: Provides a batter with a baseball-simulating target placed in a simulated strike zone in such a way as to present the batter with a realistic batting situation in a practice environment; facilitates variations in the batting situation presented to a batter for ease of operation by a trainer and the more effective development of batting skills and athletic acuity; accommodates a wide variety of batters having different physical characteristics with increased ease; provides a direct measurement of reaction time and batting accuracy for improving all facets of batting skills; enables increased ease of use through simplicity of set-up and operation; provides a lightweight, portable apparatus enabling compact storage and ease of transportation; may be utilized in a wide variety of training facilities, including facilities having severely limited training space, both indoors and outdoors; provides a rugged construction which enables reliable operation over a long service life; enables a simplified construction which is manufactured with economy in large numbers of consistent high quality.

It is to be understood that the above detailed description of a preferred embodiment of the invention is provided by way of example only. Various details of design and construction may be modified without departing from the true spirit and scope of the invention as set forth in the appended claims.

The embodiments of the invention in which an exclusive property or privilege is claimed are defined as follows:

1. Batting training apparatus for improving the batting performance of a baseball batter located adjacent a simulated strike zone and wielding a baseball bat, the batting practice apparatus comprising:

a support for placement adjacent the simulated strike zone, the support extending altitudinally to define a vertical axis;

a plurality of baseball-simulating targets, each target being spaced horizontally from the vertical axis and mounted on the support for rotation about the vertical axis so as to be movable along a path of travel passing through the simulated strike zone, the targets being spaced altitudinally from one another such that each target, when at rest, is placed at a corresponding rest position in the simulated strike zone, the rest position representing a particular pitch;

a plurality of illuminating lamps, each illuminating lamp being associated with a corresponding target at the rest position such that upon illumination of a selected one of the plurality of illuminating lamps, the corresponding target in the simulated strike zone will be illuminated;

selector means for selectively illuminating a selected one of the illuminating lamps so as to illuminate a corresponding selected target at the rest position thereof in the simulated strike zone and thereby simulate a particular pitch; and timer means for measuring the time elapsed between illumination of the selected target and the commencement of movement of the selected target away from the rest position and along the path of travel in response to striking of the illuminated target by the batter.

2. The invention of claim 1 including qualitative means for indicating the intensity and accuracy with which the illuminated target is struck by the batter.

3. The invention of claim 2 wherein the qualitative means includes a counter means for counting the number of revolutions made by the struck target about the vertical axis as the target travels along the path of travel.

4. The invention of claim 1 wherein the support includes:

a vertical post;

a plurality of bushings mounted for selective sliding movement along the vertical post for placement at selected vertical positions on the post; and a plurality of arms, each arm being journaled on a corresponding bushing for rotation about the bushing;

each target being carried by a corresponding arm for placement of the targets at selected vertical locations within the simulated strike zone.

5. The invention of claim 4 wherein locking means associated with each bushing for locking the bushing at the selected vertical position.

6. The invention of claim 4 including three said baseball-simulating targets and three said corresponding arms.

7. The invention of claim 4 including a plurality of rods, each rod being mounted on a corresponding bushing, and each illuminating lamp being carried by a corresponding rod such that each illuminating lamp is placed outside the path of travel of the corresponding target.

8. The invention of claim 4 wherein each arm includes a near end at the bushing and extends radially away from the vertical post to a far end, each arm having a redirected portion adjacent the far end, the redirected portion extending in a generally circumferential direction to present the corresponding target carried by the arm in full confrontation with the baseball bat as the bat is swung into the simulated strike zone.

9. The invention of claim 8 including mounting means for mounting each arm at each corresponding bushing, each mounting means having reversible means for enabling selective mounting of the arm with the redirected portion of the arm extending in either one of two opposite circumferential directions.

* * * * *